United States Patent [19]

Kawachi

[11] Patent Number: 4,745,334

[45] Date of Patent: May 17, 1988

[54] ELECTROLUMINESCENT ELEMENT AND METHOD FOR CONNECTING ITS TERMINALS

[75] Inventor: Kazuhiko Kawachi, Furukawa, Japan

[73] Assignee: Alps Electric Co., Ltd., Japan

[21] Appl. No.: 923,302

[22] Filed: Oct. 27, 1986

[30] Foreign Application Priority Data

Oct. 25, 1985 [JP] Japan ..... 60-237199
Oct. 25, 1985 [JP] Japan ..... 60-162853[U]

[51] Int. Cl.[4] ..... H05B 33/06; H05B 33/26

[52] U.S. Cl. ..... 313/512; 313/511; 313/506; 313/503

[58] Field of Search ..... 313/110, 500, 502, 503, 313/512, 506; 252/511, 514

[56] References Cited

U.S. PATENT DOCUMENTS 4,113,981 9/1978 Fujita et al. ..... 252/511 X
4,330,165 5/1982 Sado ..... 339/59 M
4,508,990 4/1985 Essinger ..... 313/512
4,568,592 2/1986 Kawaguchi et al. ..... 252/511 X
4,624,801 11/1986 Kawaguchi et al. ..... 252/511 X
4,626,742 12/1986 Mental ..... 313/503

*Primary Examiner*—David K. Moore
*Assistant Examiner*—Mark R. Powell
*Attorney, Agent, or Firm*—Guy W. Shoup

[57] ABSTRACT

An electroluminescence element includes a light emission layer provided between a lower electrode and a transparent electrode for emitting light in response to a voltage applied between the electrodes. The lower electrode is formed with a cutout through which a part of the transparent electrode is exposed to facilitate provision of an anisotropic, conductive, heat-adhesive sheet in contact with both electrodes to electrically and physically connect lead terminals to the lower and transparent electrodes via the sheet for introduction of the voltage.

2 Claims, 3 Drawing Sheets

ELECTROLUMINESCENT ELEMENT AND METHOD FOR CONNECTING ITS TERMINALS

FIELD OF THE INVENTION

This invention relates to an electroluminescence element (hereinafter called ELD), and more particularly to a specific arrangement and method for connecting lead terminals to a lower electrode and transparent electrode of the ELD which receives a voltage from an outer circuit through the lead terminals.

BACKGROUND OF THE INVENTION

Along with recent developments in materials and manufacturing technology of ELD which can provide brighter ELD, the use of ELD is expected in a wider industrial field. Among others, ELD of an organic dispersion type particularly draws a great attention for its modest manufacturing cost and excellent brightness.

FIGS. 4 and 5 illustrate a prior art ELD. FIG. 4 is a partly exposed bottom view, and FIG. 5 is a cross-sectional view taken along A—A line of FIG. 4. In these drawings, reference numeral 1 refers to a lower electrode made of aluminum film, 2 to a transparent electrode made by depositing an oxidized mixture of In and Sn on a transparent sheet, and 3 to a light emission layer made of powdered ZnS-Mn, ZnS-Cu, etc. They are put in lamination so as to locate the lower electrode 1 at the bottom, the transparent electrode 2 thereon and the light emission layer 3 on the top, and they form a light emission arrangement. Reference numerals 4 and 5 denote lead terminals made of a metal film of phosphor bronze. One lead terminal 4 is secured to a lower surface of the transparent electrode 2 by a conductive adhesive 6 of silver paste, whereas the other lead terminal 5 is secured to a lower surface of the lower electrode 1 by another drop of the same adhesive 6. The entire body of the light emission arrangement in the form of a lamination of the lower electrode 1, light emission layer 3 and transparent electrode 2 as well as inner end portions of the lead terminals 4 and 5 is sealed by a pair of upper and lower protective sheets 7 and 8 made of polyethylene or other hot-melt film. Opposed ends of the protective sheets 7 and 8 are joined together by heat-sealing or other method to protect the light emission arrangement against moisture or water. Outer ends of the lead terminals 4 and 5 in the exterior of the protective sheets 7 and 8 are soldered to lead wires (not shown) for electrically connecting the ELD to an outer circuit. On application of a voltage between the lower electrode 1 and transparent electrode 2 via the lead terminals 4 and 5, conductive adhesive 6 and others from the outer circuit, the light emission layer 3 emits light.

The prior art ELD uses the conductive adhesive 6 of silver paste to electrically and mechanically connect the lead terminals 4 and 5 to the electrodes 1 and 2, which silver paste, although excellent in electrical characteristic, is not sufficient in mechanical strength. Therefore, the prior art ELD is apt to invite a contact failure of the lead terminals 4 and 5 upon application of an external stress or heat shock. Beside this, the use of silver paste practically requires a process (not shown) of insulating the lead terminal 5 nearer to the lower electrode 1 from the transparent electrode 2, and also requires a specific attention during application of silver paste to prevent its overflow beyond its proper position. Thus the use of silver paste for connection of the lead terminals 4 and 5 involves various disadvantages.

OBJECT OF THE INVENTION

It is therefore an object of the invention to provide an electroluminescence element and a method for connecting lead terminals thereof which ensure a reliable strength in junctions of the lead terminals and facilitate the process of connecting same.

A further object of the invention is to provide an electroluminescence element which is free from deleterious change in the light emission layer thereof and hence maintains the original planar upper surface of the layer.

SUMMARY OF THE INVENTION

Expected application of the invention is in an electroluminescence element which comprises a light emission arrangement including a light emission layer between a lower electrode and a transparent electrode and sealed by a protective sheet means, so that the light emission layer emits light in response to a voltage applied between the lower and transparent electrodes. Unlike the prior art, an anisotropic, conductive, head-adhesive sheet made of thermoplastic resin with diffusion of conductive material therein is provided in contact with the lower and transparent electrodes which are previously united into a unitary lamination. After this, lead terminals for connection to an external circuit are put on the sheet, and a desired amount of heat and pressure is applied to the lead terminals to electrically and physically connect the lead terminals to the lower and transparent electrodes via the anisotropic, conductive, heat-adhesive sheet.

On making the united lamination of the lower electrode, light emission layer and transparent electrode, a lead portion of the transparent electrode is preferably exposed to the plane of the lower electrode to facilitate adhesion of the lead terminals to lead portions of both electrodes via the anisotropic, conductive, heat-adhesive sheet. With this specific arrangement, since the anisotropic, conductive, heat-adhesive sheet is selectively conductive and adhesive at compressed and heated portions thereof, the lead terminals are reliably connected to the lower and transparent electrodes by a simple connecting process.

BRIEF DESCRIPTION OF THE DRAWINGS

FIGS. 1 through 3 illustrate an electroluminescence element and its manufacturing process embodying the invention in which: FIG. 1 is a partly exposed bottom view of a finished electroluminescence element;

FIG. 2 is an enlarged cross-sectional view taken along B—B line of FIG. 1;

and FIG. 3 shows different steps of the manufacturing process;

DETAILED DESCRIPTION

Figure 1:
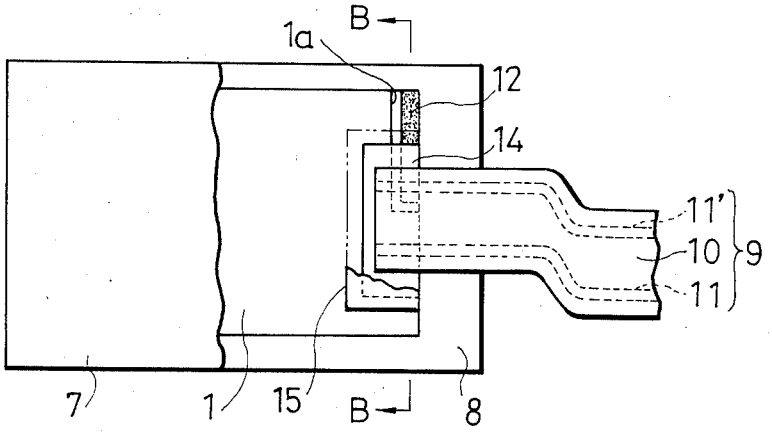

The invention is hereinbelow described in detail, referring to a preferred embodiment illustrated in the drawings.

Figure 2:
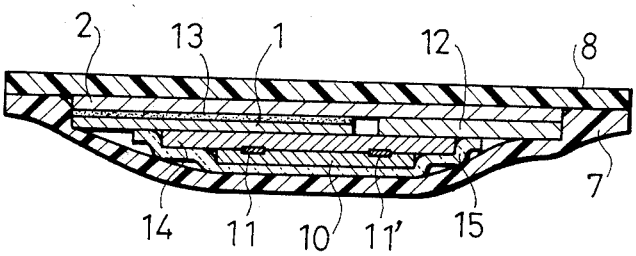
Figure 3A:
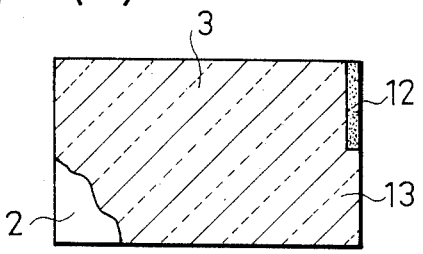
Figure 3B:
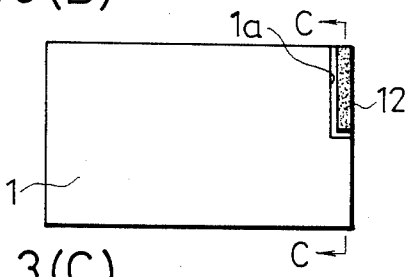
Figure 3B:
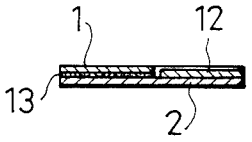
Figure 3C:
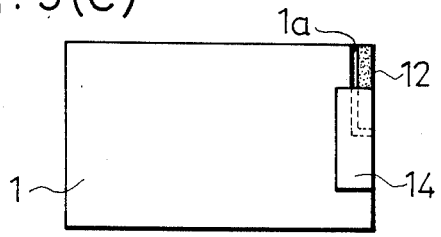
Figure 3D:
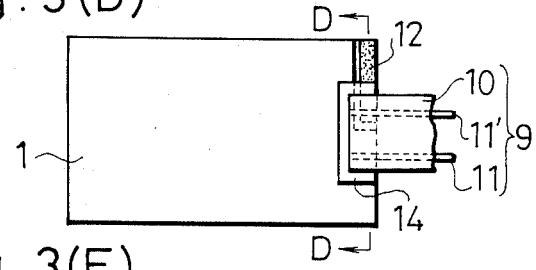
Figure 3D:
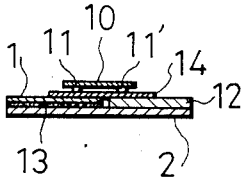
Figure 3E:
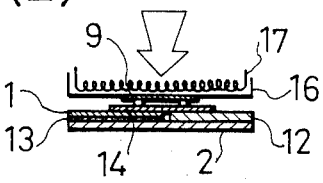
Figure 4:
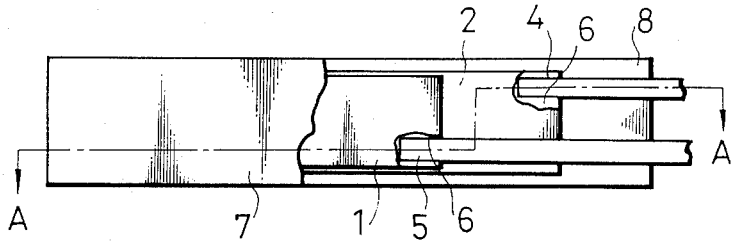
Fig. 4 PRIOR ART
FIG. 4 is a partly exposed bottom view of a prior art electroluminescence element.
Figure 5:
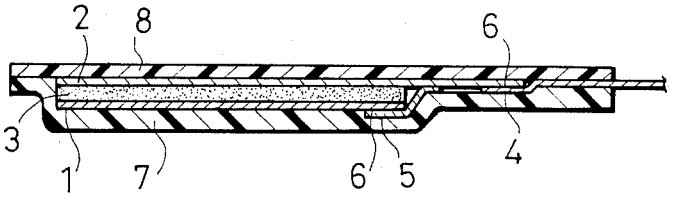
Fig. 5 PRIOR ART
FIG. 5 is a cross-sectional view taken along A—A line of FIG. 4.

FIG. 1 is a partly exposed bottom view of an ELD embodying the invention. FIG. 2 is an enlarged cross-sectional view along B—B line of FIG. 1. The same or corresponding components in FIGS. 1 and 2 as those in FIGS. 4 and 5 are designated by the same reference numerals.

In these drawings, reference numeral 9 denotes a flexible printed board including a flexible base film 10 and copper foil patterns 11—11′ provided on the base film 10. Reference numeral 12 refers to a lead electrode made from silver or other material and located on one end portion of the transparent electrode 2, and 13 denotes an insulating layer provided on the transparent electrode 2 and surrounding the lead electrode 12. The lower electrode 1 has a cutout 1*a* at one end portion thereof to expose the lead electrode 12 through the cutout 1*a* when the lower electrode 1 and transparent electrode 2 are united into a lamination. The insulating layer 13 is interposed between the lower electrode 1 and transparent electrode 2 to insulate them from each other. Therefore, the insulating layer 13 may be an extension of the light emission layer 3 interposed between the lower electrode 1 and transparent electrode 2, or alternatively may be a different insulating member. Reference numeral 14 denotes an anisotropic, conductive, heat-adhesive sheet bridging the lead electrode 12 and lower electrode 1 to electrically connect the copper foil patterns 11 and 11′ of the printed board 9 to the lower electrode 1 and lead electrode 12 on the transparent electrode 2. The sheet 14 is made by diffusing a great deal of conductive particles or fibers of carbon, metal or other material into thermoplastic resin. The sheet 14 is normally insulative, but becomes conductive and adhesive at limited portions where pressure and heat are applied. More specifically, the sheet 14 is changed conductive merely at limited portions thereof where the lead terminals 11—11′ overlap the lower electrode 1 and lead electrode 12, but remains insulative at the remainder portions. Reference numeral 15 designates a reinforcing sheet made from a hot-melt neoprene material. The reinforcing sheet 15 entirely overlaps the anisotropic, conductive, heat-adhesive sheet 14 and is secured to the lower electrode 1 along the outer margin thereof.

The light emission arrangement in the form of a lamination including the lower electrode 1, light emission layer and transparent electrode 2 and an inner end portion of the printed board 9 are sealed by a pair of upper and lower protective sheets 7 and 8 made from polyethylene or other hot-melt film, which protective sheets 7–8 are joined together at their opposed ends by heat sealing.

An exemplary process for manufacturing the described ELD is hereinbelow described in detail with reference to FIG. 3, particularly focusing on the process for connecting the lead terminals.

As shown in FIG. 3 at (A), the lead electrode 12 is silver-printed on one end portion of the transparent electrode 2. On the remainder portion of the transparent electrode 2 is formed the light emission layer 3 a part of which is used as the insulating layer 13. The light emission layer 3 need not extend to the remote end of the lead electrode 12, and in this case, a space formed at this portion may be filled by an EVA or neoprene insulating material.

In the next step shown in FIG. 3 at (B), the lower electrode 1 of aluminum foil having the cutout 1*a* at one end portion thereof is adhered to the light emission layer 3, and they are united together by a known technology into a single lamination which forms the light emission arrangement. As shown in FIG. 3 at (B′) which is a cross-sectional view taken along C—C line of the view (B), the lower electrode 1 and transparent electrode 2 are laminated, sandwiching the insulating layer therebetween, but the lead electrode 12 on the transparent electrode 2 is exposed through the cutout 1*a* at one end of the light emission arrangement.

In the subsequent step shown in FIG. 3 at (C), the anisotropic, conductive, heat-adhesive sheet 14 is put in position, bridging adjacent portions of the lead electrode 12 and lower electrode 1, and as shown in FIG. 3 at (C), the printed board 9 is put on the sheet 14, with the copper foil patterns 11—11′ thereof being opposed to the lower electrode 1 and lead electrode 12. As shown in FIG. 3 at (D′) which is a cross-sectional view taken along D—D line of the view (D), since the anisotropic, conductive, heat-adhesive sheet 14 to which no pressure is applied is interposed between the lower electrode 1 and copper foil pattern 11 and also between the lead electrode 12 and copper foil pattern 11′, the electrodes 1 and 2 are insulated from the lead terminals.

In the next step shown in FIG. 3 at (E), the printed board 9 is compressed toward the lower electrode 1 by a press 16 and heated by a heater or other heat source included in the press 17. Due to the heat, the sheet 14 is molten and adhered to the lower electrode 1 and lead electrode 12. Additionally, since the pressure from the press 16 concentrically acts on the copper foil patterns 11—11′ which project above the base film 10, the sheet 14 at these portions receives the concentrated pressure, and the conductive particles therein are tied in line in the compressing direction. Therefore, electrical conduction is established via the sheet 14 between the lower electrode 1 and copper foil pattern 11 and between the transparent electrode 2 and copper foil pattern 11′.

After this, the reinforcing sheet 15 slightly larger than the sheet 14 is put over the inner end portion of the printed board 9 and the entire part of the sheet 14 and adhered to the lower electrode 1 to more reliably support the printed board 9. Finally, the entire part of the light emission arrangement and the inner end portion of the printed board 9 are sealed by the pair of protective sheets 7 and 8 by a known sealing method, and a finished ELD of FIG. 1 is obtained.

In the described embodiment, the lead terminals for electrical connection to an outer circuit are in the form of a significantly thin printed board 9 made by forming the copper foil patterns 11—11′ on the base film 10 which is 0.1 through 0.2 mm thick approximately. Therefore, a reliable moistureproof sealing is established at the exit of the printed board 9 through the protective sheets 7 and 8, and no water vapor will enter in the interior of the ELD. When a voltage is applied between the lower electrode 1 and transparent electrode 2 via the copper foil patterns 11—11′ and sheet 14 from the printed board 9 connected to an outer circuit, the light emission layer emits light.

Due to the specific structure of the ELD, where the inner end portion of the flexible printed board 9 is sealingly closed in the cavity defined by the protective sheets 7 and 8, and where the copper foil patterns 11—11′ of the printed board 9 to serve as lead terminals are connected to the lower electrode 1 and transparent electrode 2 via the anisotropic, conductive, heat-adhesive sheet 14, the flexibility in the printed board 9 itself and a sufficient adhesion strength of the sheet 14 reliably prevent a connection fail of the lead terminals, i.e. the copper foil patterns 11—11′ upon possible application of a pulling, bending or other external force or heat shock. Beside this, since the copper foil patterns 11—11' are reliably supported and spaced on the base film 10, short circuit of the lead terminals never occurs. The lead terminals may be in the form of phosphor bronze or other metal foil used in the prior art, and can be connected to the light emission arrangement by the invention method which provides a significantly improved adhesion strength as compared to the prior art connection method using a conventional conductive adhesive.

The described embodiment uses the anisotropic, conductive, heat-adhesive sheet 14 for connection of the lead terminals 11—11', which sheet 14 is not only excellent in adhesion strength when heated, but also conductive only at compressed points thereof. Therefore, the invention arrangement or method provides a simplified manufacturing process and improved adhesion strength of the lead terminals as compared to the prior art ELD or its manufacturing method using a conductive adhesive or insulative coating.

Additionally, since the described embodiment includes the cutout 1*a* formed in the lower electrode 1 to expose the lead terminal 12 attached to the transparent electrode 2 through the cutout 1*a* and connects the exposed lead electrode 12 and the adjacent lower electrode 1 to the lead terminals 11—11' via the sheet 14, heat application to the sheet 14 can be effected at an end portion of the light emission arrangement remote from the light emission layer 3. Therefore, the light emission layer 3 is protected against the heat which possibly shortens the life thereof, and the original smooth plane of the upper surface thereof is maintained in a good condition.

In conclusion, the invention provides easier and stronger connection of the lead terminals for connection of ELD to an exterior circuit than in the prior art, because electrical conduction of the lead terminals to the lower and transparent electrodes is readily established by simply compressing and heating selected portions of the anisotropic, conductive, heat-adhesive sheet.

The embodiments of the invention in which an exclusive property or privilege is claimed are defined as follows.

1. An electroluminescent element comprising:

a transparent upper electrode (2);

an electroluminescent (EL) layer (3) in contact with the transparent electrode;

a lower electrode (1) in contact with the EL layer so that the EL layer emits light when a voltage is applied between the transparent upper electrode and the lower electrode, said lower electrode and EL layer each having a cut-out portion (1*a*) in registration with each other so as to expose the transparent upper electrode therethrough;

a lead electrode (12) having dimensions smaller than the cut-out portion and disposed within the area of the cut-out portion in contact with the transparent upper electrode but not in contact electrically with the lower electrode around the cut-out portion, wherein a lower surface of the lead electrode and an adjacent lower surface of the lower electrode in the vicinity of the cut-out portion are substantially coplanar;

an anisotropic sheet (14) placed in bridging contact across both the lower surface of the lead electrode and the adjacent lower surface of the lower electrode in the vicinity of the cut-out portion, said anisotropic sheet having the characteristic of being normally non-conductive except that it is made conductive and adhesive in local portions thereof to which heat and pressure are applied;

a flexible printed board (9) having a pair of spaced apart lead patterns (11,11') printed on one surface which are placed in contact with the anisotropic sheet such that one lead pattern is disposed in registration with the lower surface of the lead electrode, and the other lead pattern is disposed in registration with the adjacent lower surface of the lower electrode, said printed board being locally compressed toward the anisotropic sheet and heated such that an electrically conductive portion is established between the one lead pattern and the adjacent lower surface of the lower electrode, and another electrically conductive portion is established between the other lead pattern and the lower surface of the lead electrode.

2. An electroluminescent element of claim 1 further comprising a reinforcing sheet made of a hot-melt material, said reinforcing sheet covering said anisotropic, conductive, heat-adhesive sheet and adhered to said lower electrode along the outer margin thereof.

* * * * *